US010898056B2

(12) United States Patent
Liarte Marin et al.

(10) Patent No.: US 10,898,056 B2
(45) Date of Patent: Jan. 26, 2021

(54) METERING DEVICE FOR SHAPED CLEANING-AGENT BODIES IN DOMESTIC DISHWASHERS

(71) Applicant: BSH Hausgeräte GmbH, Munich (DE)

(72) Inventors: Juan Alberto Liarte Marin, Saragossa (ES); Marc Schreiber, Enschede (NL); Martijn Reinder Torenbeek, Wilp (NL); Ander Villate Robles, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 197 days.

(21) Appl. No.: 16/304,316

(22) PCT Filed: May 5, 2017

(86) PCT No.: PCT/EP2017/060772
§ 371 (c)(1),
(2) Date: Nov. 26, 2018

(87) PCT Pub. No.: WO2017/215835
PCT Pub. Date: Dec. 21, 2017

(65) Prior Publication Data

US 2019/0133411 A1 May 9, 2019

(30) Foreign Application Priority Data

Jun. 13, 2016 (DE) ..... 10 2016 210 399
Mar. 8, 2017 (DE) ..... 10 2017 203 783

(51) Int. Cl.
*A47L 15/44* (2006.01)
*D06F 39/02* (2006.01)

(52) U.S. Cl.
CPC ..... *A47L 15/4436* (2013.01); *A47L 15/4409* (2013.01); *A47L 15/4463* (2013.01); *A47L 15/4472* (2013.01); *D06F 39/026* (2013.01)

(58) Field of Classification Search
CPC ..... A47L 15/4436; A47L 15/4409; A47L 15/4463; A47L 15/4472; D06F 39/026
(Continued)

(56) References Cited

U.S. PATENT DOCUMENTS 7,896,195 B2 3/2011 Limback
9,163,349 B2 10/2015 Classen et al.
(Continued)

FOREIGN PATENT DOCUMENTS

DE 3724849 A1 * 2/1989 ..... A47L 15/4409
DE 3724849 A1 2/1989
(Continued)

OTHER PUBLICATIONS

DE3724849A1—Machine translation (Year: 1989).*
(Continued)

*Primary Examiner* — Tinsae B Ayalew
(74) *Attorney, Agent, or Firm* — Michael E. Tschupp; Andre Pallapies; Brandon G. Braun

(57) ABSTRACT

A metering device for dispensing shaped cleaning-agent bodies into a washing chamber of a domestic dishwasher, comprising a reservoir, which is designed to hold a filling of the shaped cleaning-agent bodies and has a transfer opening in a region of the bottom of the reservoir, and a transport device for actively transporting the shaped cleaning-agent bodies from the transfer opening of the reservoir into the washing chamber. In addition, the metering device comprises a lifting device for raising the bottom of the reservoir at least in parts, wherein a discharge slant toward the transfer opening is produced at least in parts or the downgrade of an existing discharge slant is increased at least in parts by the raising of the bottom.

21 Claims, 12 Drawing Sheets

(58) Field of Classification Search
USPC ..... 134/93
See application file for complete search history.

(56) References Cited

U.S. PATENT DOCUMENTS

| | | | | |
|---|---|---|---|---|
| 2003/0106570 | A1* | 6/2003 | Cerruti | A47L 15/4409 134/18 |
| 2004/0069325 | A1* | 4/2004 | Cerruti | A47L 15/4418 134/25.2 |
| 2015/0359412 | A1 | 12/2015 | Delgado et al. | |

FOREIGN PATENT DOCUMENTS

| | | | | |
|---|---|---|---|---|
| DE | 10058460 | A1 | 5/2002 | |
| DE | 10158605 | A1 | 6/2003 | |
| DE | 60225529 | T2 | 4/2009 | |
| EP | 1159913 | A1 | 12/2001 | |
| EP | 1355561 | B1 * | 3/2008 | A47L 15/4472 |
| JP | 2000300498 | A | 10/2000 | |

OTHER PUBLICATIONS

National Search Report DE 10 2016 210 399.7 dated May 19, 2017.
International Search Report PCT/EP2017/060722 dated Jun. 22, 2017.

* cited by examiner

METERING DEVICE FOR SHAPED CLEANING-AGENT BODIES IN DOMESTIC DISHWASHERS

CROSS-REFERENCES TO RELATED APPLICATIONS

This application is the U.S. National Stage of International Application No. PCT/EP2017/060772, filed May 5, 2017, which designated the United States and has been published as International Publication No. WO 2017/215835 A1 and which claims the priorities of German Patent Applications, Serial No. 10 2016 210 399.7, filed Jun. 13, 2016 and 10 2017 203 783.0, filed Mar. 8, 2017, pursuant to 35 U.S.C. 119(a)-(d).

BACKGROUND OF THE INVENTION

The present invention relates to a metering device for dispensing shaped cleaning-agent bodies into a washing chamber of a household dishwasher.

In commercially available household dishwashers, it is necessary to add cleaning agent manually in powder form or in the form of tablets before the start of a washing process. It is usual for merely the rinse aid to be stored in liquid form in a reservoir inside the household dishwasher for multiple applications and to be added automatically via a metering device. The manual addition of cleaning agent before each washing process is regarded by many users as tiresome and inconvenient. As a result, attempts have been made for some time to develop so-called automatic metering systems for household dishwashers, which are designed to permit cleaning agent also to be stored in reservoirs for multiple applications and to be added automatically via corresponding metering devices.

For example, a metering device for dispensing cleaning tablets from a reservoir into the usable space of a dishwasher is disclosed in EP 1 159 913 A1, in which a substantially vapor-tight lock is arranged between the reservoir and the usable space. The reservoir in this case is configured for holding a loose filling of tablets and the lock has a transport device, for example in the form of a cell wheel, for actively transporting the tablets through said lock. The supply of tablets from the reservoir to the transport device is able to take place exclusively by gravity. However, a conveying apparatus which actively conveys the tablets (under the action of external force) from the reservoir to the transport device is preferred.

The extremely limited constructional space available in household dishwashers always constitutes a specific requirement in the development of automatic metering systems.

BRIEF SUMMARY OF THE INVENTION

The object of the invention is to provide a compact metering device for dispensing shaped cleaning-agent bodies from a reservoir into a washing chamber of a household dishwasher, which permits a reliable automatic dispensing of shaped cleaning-agent bodies for a plurality of successive washing processes.

Accordingly, the metering device comprises a reservoir which is designed to hold a filling of the shaped cleaning-agent bodies and has a transfer opening in a region of the bottom of the reservoir. The metering device also comprises a transport device for actively transporting the shaped cleaning-agent bodies from the transfer opening of the reservoir into the washing chamber of the household dishwasher.

According to the invention, a lifting device is provided, said lifting device being configured and designed for raising the bottom of the reservoir at least in parts, wherein a discharge slant toward the transfer opening is produced at least in parts or the downgrade of an existing discharge slant is increased at least in parts by the raising of the bottom.

The term "shaped cleaning-agent bodies" is intended to be understood within the scope of the invention as all shaped bodies with a defined external shape, which contain any constituents which are able to be used within the context of cleaning crockery. For example, tablets, pellets, granules or capsules fall within this term. The term is also not limited to shaped bodies which contain the actual cleaning agent. Rather, shaped bodies which comprise additives for use in rinsing cycles, for water-softening or water-conditioning and the like, are also intended to be encompassed thereby.

The reservoir is that region of the metering device which contains the store of shaped cleaning-agent bodies. The reservoir is designed to be refillable or even to be replaceable, for example in the form of a cartridge. The reservoir is designed to hold a filling, in particular a loose filling of shaped cleaning-agent bodies. This means that the shaped cleaning-agent bodies are randomly oriented in the reservoir and are not stored in a predetermined geometric arrangement.

The embodiment of the reservoir according to the invention to hold a filling of shaped cleaning-agent bodies permits simple and compact storage, even of larger quantities of shaped cleaning-agent bodies. Complex storage of the tablets is not required.

The wall portion on which the shaped cleaning-agent bodies are located due to gravity in the operating position of the reservoir is to be regarded as the bottom of the reservoir. The transfer opening arranged in the region of the bottom of the reservoir permits the supply of shaped cleaning-agent bodies to the transfer opening to be carried out exclusively by gravity or at least to be assisted by gravity. The "operating position" of the reservoir and thus also of the metering device is understood to mean the position in which the cleaning agent is metered when the household dishwasher is used correctly.

The transport device is preferably configured for carrying out discrete transport processes, wherein a predetermined quantity of cleaning agent in the form of shaped cleaning-agent bodies is transported in each transport process. The transport device may comprise, for example, a rotatably mounted cell wheel, at least one transport chamber being arranged on the periphery thereof.

The active transport of the shaped cleaning-agent bodies from the transfer opening of the reservoir into the washing chamber results in a desired quantity of cleaning agent being metered in a reliable manner. "Active transport" in this case means that the shaped cleaning-agent bodies are transported by the action of an external force. For example, a cell wheel may be actively rotated by means of a drive unit, for example an electric motor.

The lifting device according to the invention enables the bottom of the reservoir to be raised at least in parts and namely such that a discharge slant toward the transfer opening is produced at least in parts or the downgrade (the negative incline) of an already existing discharge slant is increased at least in parts by the raising process. In this manner, when the reservoir is filled to a maximum extent (when first using a new, filled reservoir or immediately after a refilling process) it is possible to align the bottom initially such that a constructional space available inside the household dishwasher is utilized as optimally as possible. As a result, it is achieved that as many shaped cleaning-agent bodies as possible may be held and, as a result, as many washing processes as possible may be carried out without refilling or replacing the reservoir. However, if the shaped cleaning-agent bodies are supplied to the transfer opening by gravity, or at least assisted by gravity, when the filling level of the reservoir reduces it may result in the shaped cleaning-agent bodies no longer being supplied in a reliable manner, since gravity is no longer sufficient and/or is incorrectly oriented. This problem is now remedied by a discharge slant toward the transfer opening being produced at least in parts or the downgrade of an already existing discharge slant being increased at least in parts by the raising process. In this manner, the supply of shaped cleaning-agent bodies by gravity, or assisted by gravity, is facilitated such that a reliable supply is ensured even when the filling level reduces.

In order to achieve a high level of user-friendliness for the customer it is advantageous if the lifting device is embodied and designed such that the bottom of the reservoir is raised automatically, i.e. without manual intervention, at least in parts when the quantity of shaped cleaning-agent bodies reduces in the reservoir. If the lifting device is provided with at least one spring means, for example in the form of a spiral spring and/or helical spring, the effect of the automatic raising may be achieved cost-effectively and by simple structural means.

As an alternative and/or additionally to the use of spiral or helical springs, the spring means may also be formed by an elastic strip. It is particularly advantageous if the bottom of the reservoir is formed at least in a partial region by the elastic strip itself.

In order to reduce the structural and financial cost as far as possible, it is expedient to effect the raising of the bottom at least partially, preferably exclusively, by the reducing weight of the shaped cleaning-agent bodies. This may be achieved, for example, by the weight force produced by the shaped cleaning-agent bodies counteracting the spring force of the at least one spring means. In this case, the at least one spring means is designed such that the spring force is sufficiently great that the bottom is in its non-raised initial position when the fully filled position is present and is successively raised when the filling level reduces and thus also the weight reduces.

A further embodiment of the invention provides that the bottom of the reservoir is formed by at least one portion of an articulated wall. In this case, it is advantageous to provide a guide on a wall of the reservoir adjacent to the bottom, said guide being able to serve at the same time as a seal for the adjacent wall. Depending on the type of shaped cleaning-agent bodies used, such a seal may be advantageous or even necessary.

According to a further embodiment of the metering device, a further guide means corresponding to the guide means is provided on the bottom, wherein the guide means and the further guide means cooperate such that, when raised, the bottom is exclusively movable along a path predetermined by the guide means.

In this embodiment, it is advantageously ensured that the jamming and/or twisting of the bottom in the reservoir is excluded.

According to a further embodiment of the metering device, the guide means has a rectangular external shape and the further guide means has a rectangular internal shape corresponding to the guide means, wherein the further guide means fully encompasses the guide means or is encompassed by three sides and is at least partially encompassed by the fourth side.

Advantageously, the guide means and the further guide means are adapted to one another such that a surface contact is present on the corresponding sides of the guide means and/or the further guide means. It could also be said that the corresponding sides of the guide means and/or of the further guide means fit snugly against one another. This may be ensured, for example, by the guide means being configured with an external periphery of (5×10) $mm^2$ and the further guide means being configured with an internal periphery of (5.05×10.1) $mm^2$. Thus it is ensured that a mechanical clearance between the guide means and the further guide means at the same time permits simple assembly and effectively prevents an undesired movement of the guide means relative to the further guide means and thus of the bottom in the reservoir.

According to a further embodiment of the metering device, a latching connection with a plurality of latching means is provided on a wall adjacent to the bottom and/or on the guide means, and a latch is provided on the further guide means and/or on the bottom, wherein the latch and the latching means of the latched connection cooperate such that a locking direction along the guide means and a release direction along the guide means limit the raising of the bottom.

This embodiment advantageously prevents the bottom from slipping back when the bottom has been raised by a specific distance. Thus an inclination of the bottom once reached will even be maintained when, for example, the spring is too weak in order to bear the weight of the shaped cleaning-agent bodies.

Advantageously, therefore, even a weaker spring may be used, for example, which may save costs. The latching connection and the latch thus cooperate, in particular, in the manner of a linear freewheel.

According to a further embodiment of the metering device, the latch is configured as an elastic element, wherein an elastic deformation of the elastic element permits a movement of the bottom in the release direction.

The elastic element is configured, for example, as a leaf spring. The elastic element is, in particular, produced from a plastics material or from metal. The elastic element is, for example, deformed in an elastic manner when, during a movement of the bottom, it strikes a latching means in the release direction. As soon as the latching means is overcome, the elastic element automatically returns into its initial position. Due to the shape of the latching means and also of the elastic element, an asymmetry which deploys a self-locking action is produced.

Advantageously, the elastic element may be configured, for example, integrally from a portion of the further guide means, for example on a lower end of the further guide means.

According to a further embodiment of the metering device, a spacing is provided between the latching means, so that upward and downward movements of the bottom are possible up to an amplitude of the length of the spacing.

This embodiment permits minor movements of the bottom, such as for example shaking. Such small movements promote a rearrangement of the shaped cleaning-agent bodies in the reservoir. This corresponds to a loosening effect which counteracts the jamming or blocking of the shaped cleaning-agent bodies. A reliable function of the metering device may be enhanced thereby.

According to a further embodiment of the metering device, the guide means and/or the further guide means cover the latching connection.

By means of this embodiment it is advantageously ensured that the shaped cleaning-agent bodies are not jammed between a latching means and the bottom, which would block a further raising of the bottom.

If a household dishwasher is provided with a metering device according to the invention, this metering device may be arranged, for example, on a door of the household dishwasher. According to one embodiment of the invention, in this case it is provided that the spring means are embodied and designed such that the bottom of the reservoir is only raised when the door is open and accordingly without being loaded by the weight of the shaped cleaning-agent bodies. The advantage of this design is that the shaped cleaning-agent bodies inside the reservoir are subjected to a significantly lower pressing force so that there is an even greater likelihood that agglutination or compaction is excluded. If required, by opening and/or closing the door a mechanical assistance of the raising process of the bottom of the reservoir may also be effected.

A further embodiment of the invention provides that the bottom of the reservoir has at least one recess which connects the reservoir to a cavity below the bottom, wherein the recess is configured such that the shaped cleaning-agent bodies are prevented from falling through the recess. Such a recess is capable, in particular, of permitting fine cleaning-agent particles, which are produced for example by mechanical abrasion of the shaped cleaning-agent bodies, to fall through the recess into the cavity below the bottom in the reservoir but is capable of holding back the shaped cleaning-agent bodies. Thus it may be easily prevented that such particles block the transport device or lead to other problems. The recess forms, in particular, a connection of the reservoir to the cavity below the bottom of the reservoir, which is formed by the bottom being raised by the lifting device.

If the shaped cleaning-agent bodies rub against one another, for example when slipping down, if a few of the shaped cleaning-agent bodies have been conveyed into the washing chamber, abraded matter from the cleaning agent may accumulate. The abraded matter comprises, for example, small particles of dust having a small particle size, i.e. in the range of micrometers up to a few millimeters in diameter. The recess is dimensioned so that these particles are able to fall through. At the same time, however, the recess is sufficiently small for the shaped cleaning-agent bodies not to be able to fall through.

The size ratio of the shaped cleaning-agent bodies to the recess may also be described as follows. A sphere may be defined for each body, such that the sphere is the largest sphere which is located entirely within the respective body. In the case of regular polyhedrons, for example, this sphere is denoted as an inner sphere. Accordingly, a circle of maximum size may be defined for any surface, said circle being located entirely inside the surface and also being able to be called an inner circle. The requirement of not falling through is at least always fulfilled when the diameter of the inner sphere of the shaped cleaning-agent bodies is larger than the diameter of the inner circle of the recess. For example, the diameter of the inner circle of an elongated rectangular gap is the same as the width of the gap when the width describes the shorter side of the rectangle. For a cylindrical-shaped cleaning-agent body the diameter of the inner sphere is provided by the smaller characteristic length of the cylinder. The characteristic lengths of the cylinder are the height of the cylinder and the diameter of the cylinder.

In particular cases, however, this condition may also be exceeded, i.e. the inner circle diameter of the recess is then greater than the inner sphere diameter of the shaped cleaning-agent bodies. This depends on the respective shape of the shaped cleaning bodies and the recess. If, for example, the shaped cleaning-agent bodies are cylindrical, wherein the height is smaller than the diameter of the cylinder and the recess is circular, then such a shaped cleaning-agent body may not fall through the recess as long as the diameter of the recess is smaller than the diameter of the cylinder.

In a further embodiment, the recess is configured as a gap arranged between the bottom and an adjacent wall. In this case, in particular, the width of the gap is limited such that the shaped cleaning-agent bodies are held back. Moreover, in particular, separators may also be provided, for example pins or spacers, which ensure that this spacing is maintained. Advantageously, the separators may be used at the same time as guide means for the bottom and/or as protection against the bottom slipping back. In further embodiments, a number of recesses, such as holes or slots, is provided in the surface of the bottom. In this case, in order to achieve the desired effect the geometric design of the recess is irrelevant.

BRIEF DESCRIPTION OF THE DRAWINGS

Further advantageous embodiments and features of the invention form the subject-matter of the subclaims and the exemplary embodiments of the invention described hereinafter. The invention is described in more detail hereinafter by means of preferred embodiments with reference to the accompanying drawings.

In the drawings.

DETAILED DESCRIPTION OF EXEMPLARY EMBODIMENTS OF THE PRESENT INVENTION

Figure 1:
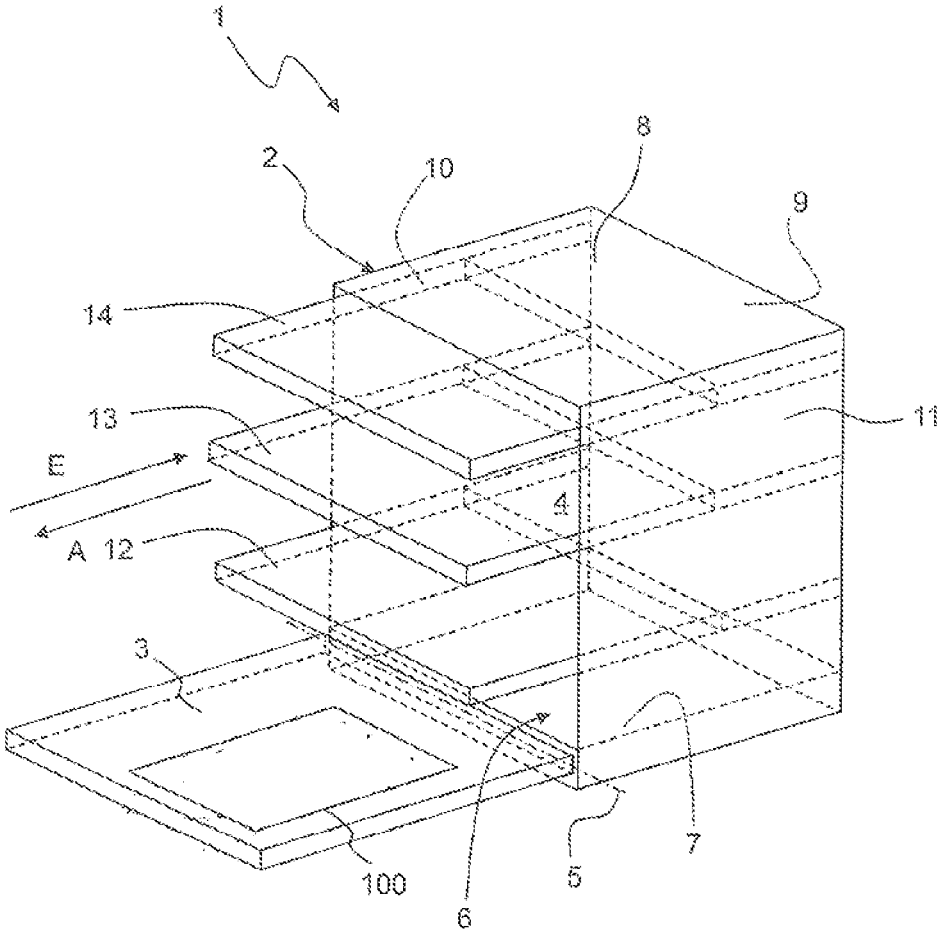
FIG. 1 shows a schematic perspective view of an embodiment of a household dishwasher.

Elements which are the same or functionally the same are provided in the figures with the same reference numerals provided nothing further is specified.

FIG. 1 shows a schematic perspective view of a household dishwasher 1. The dishwasher 1 has a receiving region in the form of a dishwasher cavity 2, which is able to be closed by a door 3, in particular in a watertight manner. To this end, a sealing device may be provided between the door 3 and the dishwasher cavity 2. The dishwasher cavity 2 is preferably cuboidal. In particular, the dishwasher cavity 2 may be produced from steel plate. Alternatively, the dishwasher cavity 2 may be produced at least partially from a plastics material. The dishwasher cavity 2 and the door 3 may form a washing chamber 4 so that washing items may be washed. The dishwasher cavity 2 may be arranged in the interior of a housing of the dishwasher 1.

The door 3 is shown in FIG. 1 in its open position. The door 3 may be closed or opened by pivoting about a pivot axis 5 provided on a lower end of the door 3. The dishwasher cavity 2 has a wall 6 with a bottom 7, a top wall 8 arranged opposite the bottom 7, a rear wall 9 arranged opposite the door 3 and two side walls 10, 11 arranged opposite one another. The bottom 7, the top wall 8, the rear wall 9 and the side walls 10, 11 may be produced, for example, from stainless steel plate. Alternatively, for example, the bottom 7 may be produced from a plastics material.

The dishwasher 1 further comprises at least one washing item receptacle 12 to 14. In particular, a plurality of washing item receptacles 12 to 14 may be provided, wherein said washing item receptacles may comprise a lower basket 12, an upper basket 13 and/or a cutlery drawer 14. The plurality of washing item receptacles 12 to 14 are preferably arranged one above the other in the dishwasher cavity 2. Each washing item receptacle 12 to 14 is optionally displaceable into the dishwasher cavity 2 or out of said dishwasher cavity. In particular, each washing item receptacle 12 to 14 is able to be pushed into the receiving region 2 in an insertion direction E and is able to be pulled out of the dishwasher cavity 2 counter to the insertion direction E in an extension direction A.

The dishwasher 1 further comprises a metering device 100. The metering device 100 in the example of FIG. 1 is arranged on the door 3, so that when the door is closed 3 it is oriented toward the washing chamber 4. This advantageously enables the metering device 100 to meter the shaped cleaning-agent bodies 102 into the washing chamber 4. The shaped cleaning-agent bodies 102 are then dissolved by the washing liquor located in the washing chamber 4.

Departing from the view in FIG. 1, further arrangements of the metering device 100 are possible, such as for example on the wall 6 of the dishwasher cavity 2 or on one of the washing item receptacles 12 to 14.

Figure 2:
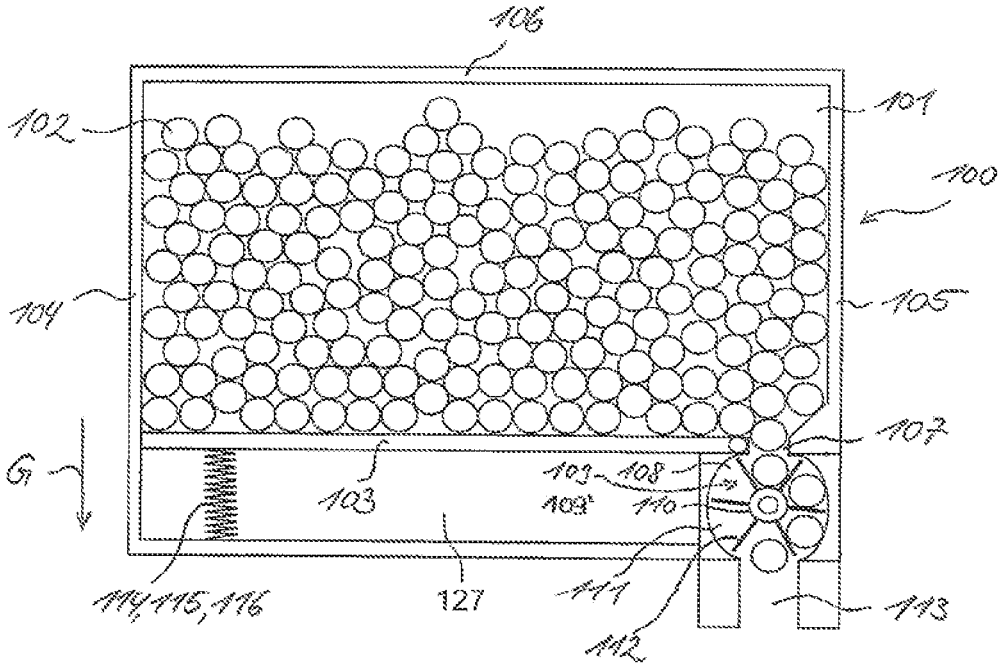
FIG. 2 shows a schematic view of a first embodiment of a metering device according to the invention with a full reservoir.

FIG. 2 shows an embodiment of a metering device 100 according to the invention. Shaped cleaning-agent bodies 102 are located in a reservoir 101. The reservoir 101 has a bottom 103, side walls 104, 105 and a top wall 106. The reservoir 101, as shown, may be configured as part of a cartridge which is completely replaced after the store of shaped cleaning-agent bodies 102 has been used up. Alternatively, however, the top wall 106 may also be designed to be removable or pivotable so that it is possible to refill the reservoir 101. The reservoir 101 in FIG. 2 is shown in a state in which as many shaped cleaning-agent bodies 102 are stored in the reservoir 101 that the bottom 103 is in the initial position, which it also adopts when completely filled. In the exemplary embodiment shown, in which the reservoir 101 is designed as a cuboidal container and the metering device 100 is shown in the operating position, accordingly the bottom 103 is initially located horizontally. The direction of gravity in the operating position of the metering device 100 is identified in FIG. 2 by an arrow G. Below the bottom 103 is located a cavity 127 in which in this exemplary embodiment the lifting device 114 is arranged, in the present case said lifting device being configured as a helical spring 116.

In the region of the bottom 103 of the reservoir 101 a transfer opening 107 is provided and in the direction of gravity G a cavity 108 adjoins the transfer opening 107, a transport device 109' in the form of a rotatably mounted cell wheel 109 being arranged in said cavity. The cell wheel 109 has a drive cylinder 110 which is actively driven by a drive unit, not shown, for example in the form of an electric motor. The cell wheel 109 also comprises a plurality of transport chambers 111 which in each case are configured for receiving a predetermined quantity of shaped cleaning-agent bodies 102. Here, the transport chambers 111 are separated from one another in each case by partitions 112 protruding radially from the drive cylinder 110. The partitions 112 are fastened to the drive cylinder 110, preferably integrally configured therewith.

On the one hand, the reservoir 101 with its transfer opening 107 and, on the other hand, an ejection channel 113 discharge into the periphery of the cell wheel 109.

During the operation of the metering device 100, shaped cleaning-agent bodies 102 located in the reservoir 101 are initially moved by gravity in the direction of the transfer opening 107 and in this manner are supplied to the cell wheel 109. During the rotational movement of the cell wheel 109, in each case a quantity of shaped cleaning-agent bodies 102 defined by the receiving volume of the transport chambers 111 falls out of the reservoir 101 through the transfer opening 107 into an empty transport chamber 111.

The shaped cleaning-agent bodies 102 are ejected through the ejection channel 113 which is located diametrically on the opposite side of the periphery of the cavity 108, and fall from there into the washing chamber 4 of the household dishwasher 1.

Figure 3:
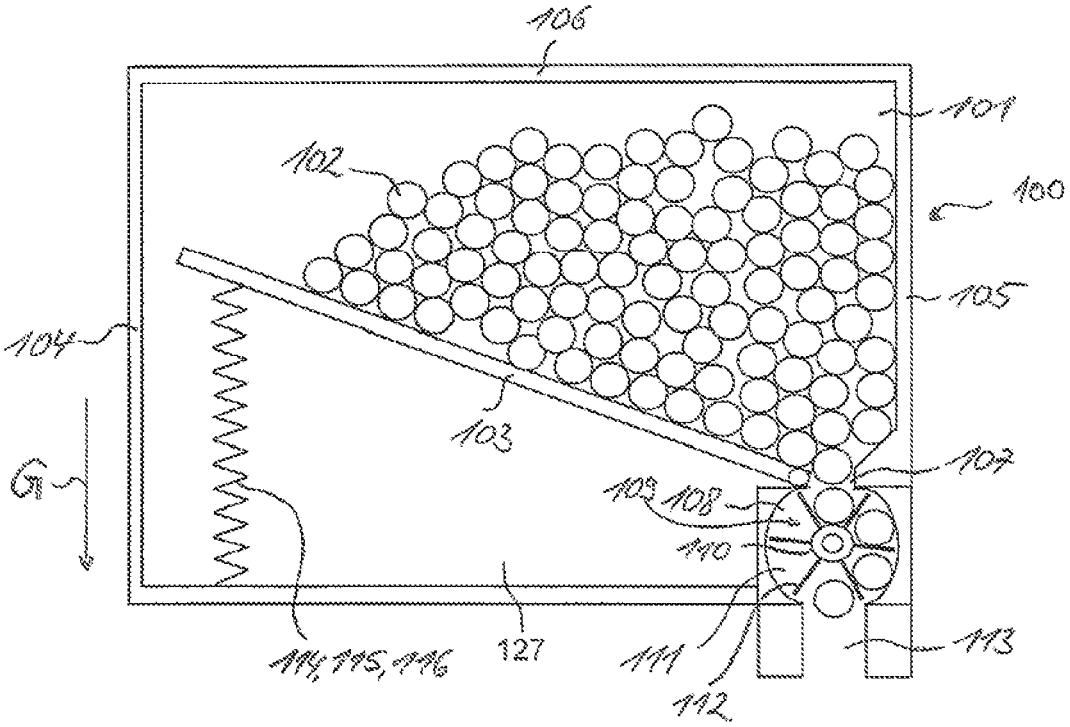
FIG. 3 shows a schematic view of the first embodiment of the metering device according to the invention with a partially emptied reservoir.

FIG. 3 now shows the metering device 100 in a state in which the reservoir 101 is still only partially filled with shaped cleaning-agent bodies 102. By the repeated metering of shaped cleaning-agent bodies 102 into the washing chamber 4, the quantity of shaped cleaning-agent bodies 102 reduces in the reservoir 101 and thus the weight thereof. The result of this weight reduction is that a lifting device 114, which in the exemplary embodiment shown is designed as spring means 115 in the form of a helical spring 116, automatically raises the bottom 103 of the reservoir 101 in a partial region, wherein a discharge slant toward the transfer opening 107 is produced by the bottom 103 being raised. This discharge slant ensures that the supply of shaped cleaning-agent bodies 102 to the transfer opening 107 by gravity also functions in a reliable manner when the filling level of the reservoir 101 reduces. In practice, in this exemplary embodiment the discharge slant is produced by the bottom 103 being rotatably mounted in the vicinity of the transfer opening 107 and the helical spring 116 spaced apart therefrom acting on the bottom 103. As an alternative or in addition to the helical spring 116, for example, a spiral spring could also be provided in the region of the rotary bearing of the bottom 103 adjacent to the transfer opening 107.

In the exemplary embodiment shown, the bottom 103 of the reservoir 101 was horizontally aligned in its initial position (when completely filled), so that the discharge slant was only produced by raising the bottom 103 by means of the lifting device 114. Naturally from the start, i.e. when the reservoir 101 is fully loaded, the bottom 103 may form a discharge slant. In this case, only the downgrade (negative incline) of the discharge slant in the direction of the transfer opening 107 is increased by the raising procedure. At this point a graphical representation of such an embodiment is dispensed with, since it would differ from the embodiment shown in FIGS. 2 and 3 only in that in the initial position (see FIG. 2) the bottom might already be slightly raised, which might also be easily implemented by a corresponding design of the helical spring 116.

Figure 4:
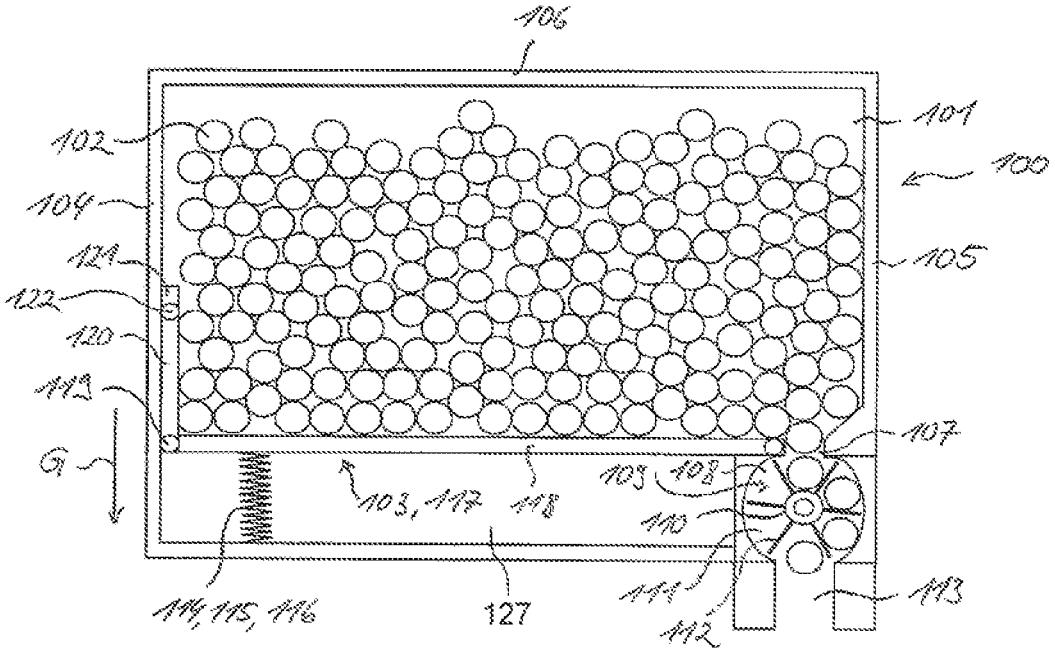
FIG. 4 shows a schematic view of a second embodiment of a metering device according to the invention with a full reservoir.
Figure 5:
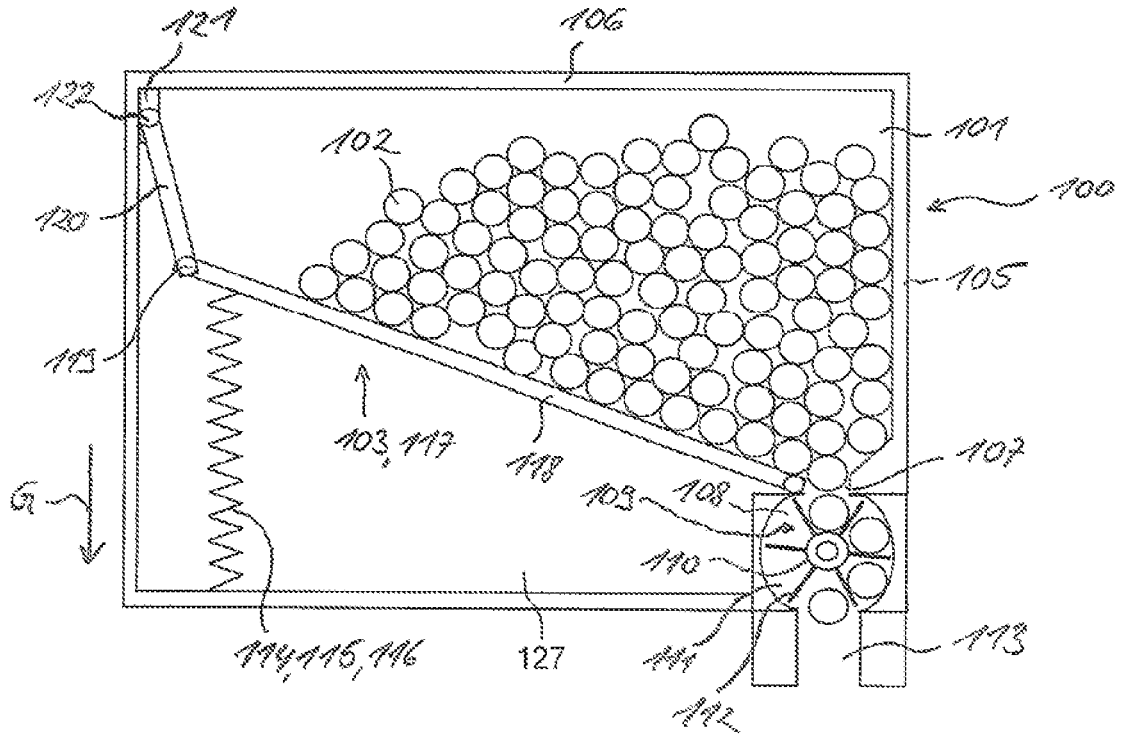
FIG. 5 shows a schematic view of the second embodiment of the metering device according to the invention with a partially emptied reservoir.

FIGS. 4 and 5 show a further embodiment of a metering device 100 according to the invention which substantially differs from the embodiment shown in FIGS. 2 and 3 in that the bottom 103 in this case is designed as a partially articulated wall 117. According to the invention this is to be understood as any type of wall which comprises at least two partial portions which are movable relative to one another. In the example shown, the bottom 103 comprises a first partial portion 118 which, as in the case of the bottom 103 according to the embodiment shown in FIGS. 2 and 3, is horizontally aligned (FIG. 4) in the initial state. A second partial portion 120, which is connected via a joint 119 to the first partial portion 118, in this initial state bears flat against the side wall 104 of the reservoir 101. This second partial portion 120 is guided via a guide means 121, for example in the form of a slide, on the side wall 104 and accordingly may also provide a seal relative to the side wall 104 of the reservoir 101. Depending on the shape, size and consistency of the shaped cleaning-agent bodies 102 used, this may be helpful or even necessary. In the exemplary embodiment shown, the second partial portion 120 of the articulated wall 117 is also connected in an articulated manner via a further joint 122 to the guide means 121, but other embodiments of the articulated wall 117 are also conceivable.

Figure 6:
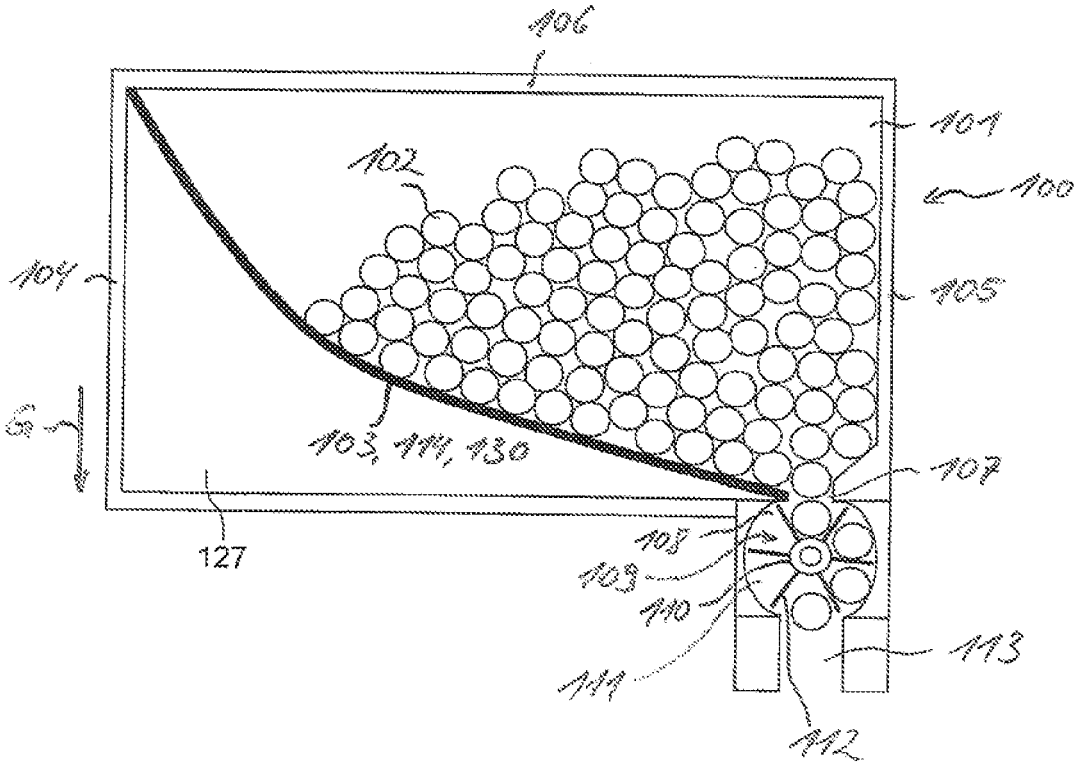
FIG. 6 shows a schematic view of a third embodiment of a metering device according to the invention with a partially emptied reservoir.
Figure 7:
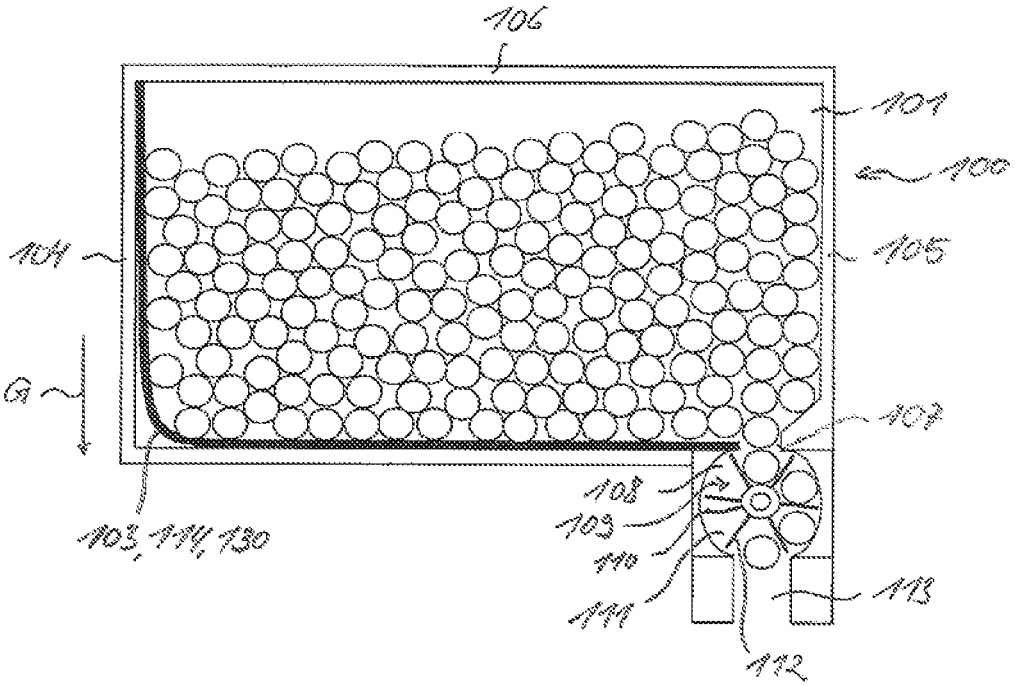
FIG. 7 shows a schematic view of the third embodiment of the metering device according to the invention with a full reservoir.

A further embodiment of a metering device according to the invention is shown in FIGS. 6 and 7, wherein FIG. 7 in turn shows the initial position when the reservoir 101 is completely filled, whereas a state with the partially emptied reservoir is shown in FIG. 6. In contrast to the embodiments described above, in this case the bottom 103 of the reservoir 101 is formed by an elastic strip 130. The elastic strip 130, however, not only serves as a bottom 103 but at the same time also undertakes the function of the lifting device 114. In the embodiment shown, the entire bottom 103 of the reservoir 101 is replaced by the elastic strip. However, it is also conceivable to design only a partial region as an elastic strip, in particular in the region of the fastening points of the bottom 103. Moreover, it is naturally possible to use an elastic strip only as an alternative spring means 115 and thus as an alternative lifting device 114 without using the elastic strip as a bottom 103.

Figure 8A:
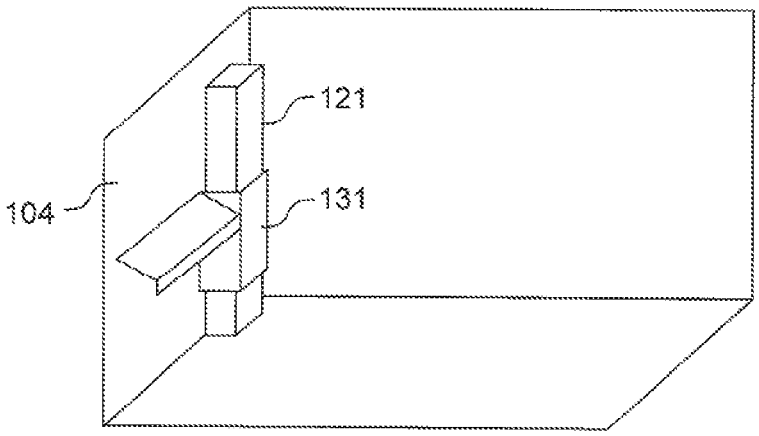
FIGS. 8A-8B show in each case a schematic view of an embodiment of a guide means and a further guide means.
Figure 8B:
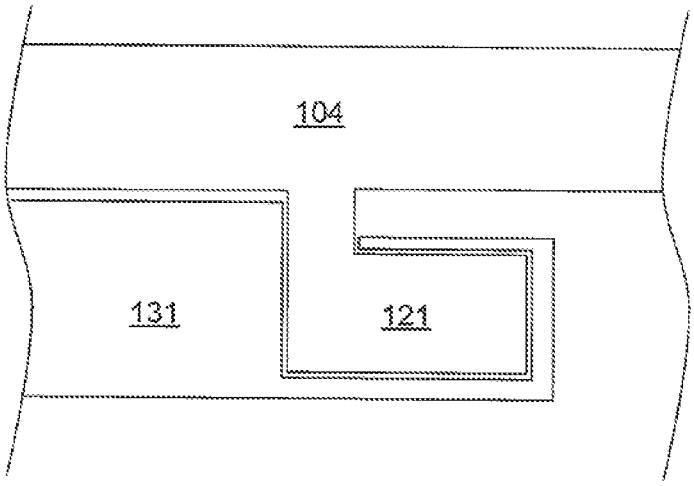

FIG. 8A shows a schematic perspective view of an embodiment of a guide means 121 which is arranged on the rear side wall 104 of the reservoir 101 and a further guide means 131 which is arranged on the bottom 103 of the reservoir 101 (see FIGS. 2-5), wherein for reasons of clarity a view of the bottom 103 and further details of the metering device 100 in FIG. 8A have been dispensed with. FIG. 8B shows a plan view from above of the guide means 121 shown in FIG. 8A and the further guide means 131 in order to make clear the interlocking of the two parts to form the guide. As may be identified in FIG. 8B, the guide means 121 has a substantially rectangular external shape. The rectangular external shape is only interrupted by the connection of the guide means 121 to the side wall 104. The further guide means 131 has a corresponding substantially rectangular internal shape. Also in this case the rectangular internal shape is only interrupted due to the attachment of the guide means 121 to the side wall 104. The further guide means 131 encloses the guide means 121 on three sides and on the fourth side, at least as long as it permits the connection of the guide means 121 to the side wall 104.

As an alternative to this embodiment, for example, the guide means 121 may also be attached to the top wall 106 of the reservoir 101 (see FIGS. 2-5), so that the connection of the guide means 121 to the side wall 104 is dispensed with. Then the further guide means 131 may also completely enclose the guide means 121.

Figure 9A:
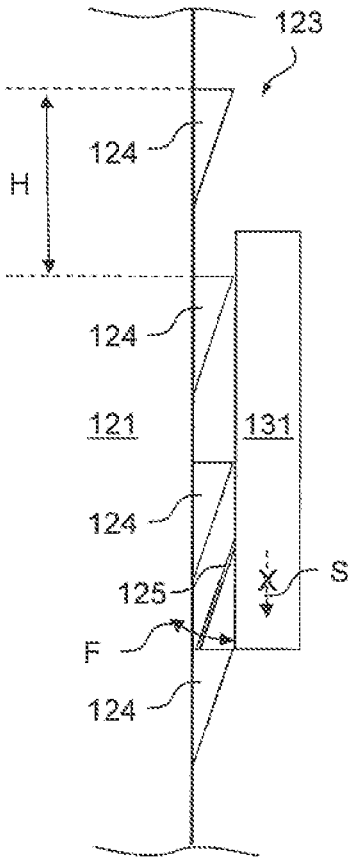
FIGS. 9A-9C show in each case a schematic view of the cooperation of a latching connection and a latch for producing a release direction and a locking direction.
Figure 9B:
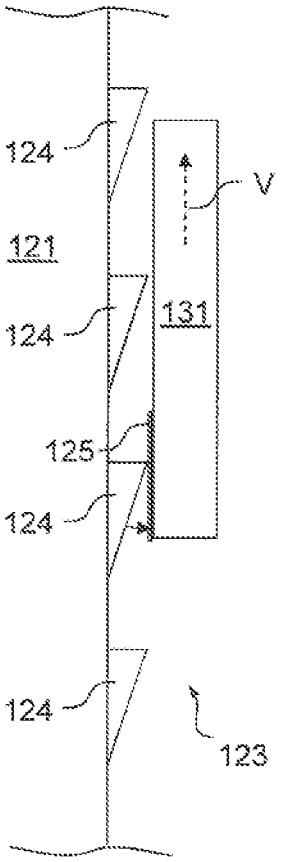
Figure 9C:
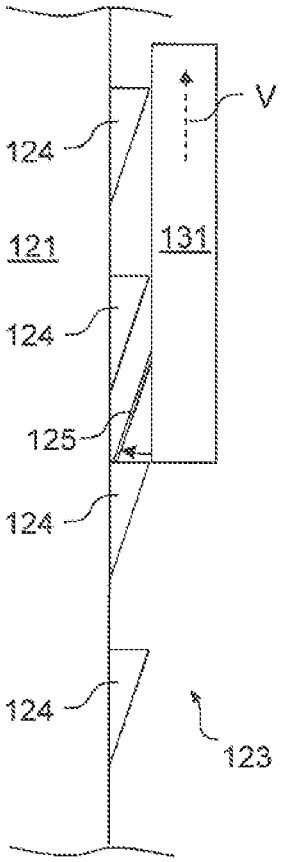

FIGS. 9A to 9C show in each case a schematic view of the cooperation of a latching connection 123 with a number of latching means 124 and a latch 125 arranged on the further guide means 131. The latch 125 is configured here, for example, as a flexible element and is movable by a corresponding action of force along the arrow F. The latching means 124 here, for example, are arranged on the guide means 121 and together form the latching connection 123. The latching means 124 in each case have a spacing H which in FIG. 9A is illustrated for the uppermost pair of latching means. This spacing H between the individual latching means 124 predetermines a freedom of movement within which the further guide means 131 is able to be moved up and down in the guide device, without a locking action being effected by the latch 125 and the latching connection 123. The cooperation of the latch 125 with the latching means 124 of the latching connection 123 for producing the locking action is described hereinafter.

FIG. 9A shows the guide means 131 in a resting position with a latch 125 engaged on the lowermost latching means 124. The latch 125 is shown in FIG. 9A in its relaxed position which it adopts when no forces act thereupon. The latch 125 effectively prevents, therefore, a movement of the further guide means 131 in the locking direction S. A movement of the further guide means 131 upwardly, however, is possible as is described hereinafter with reference to FIGS. 9B and 9C.

FIG. 9B shows how the further guide means 131 is moved upwardly in a direction of movement V. The second latching means 124 presses onto the latch 125 which, therefore, is elastically deformed and forced in the direction of the further guide means 131. Thus the further guide means 131 may move upwardly without difficulty.

FIG. 9C shows how the latch 125 automatically snaps back into the initial position, as soon as the further guide means 131 has been raised sufficiently far that the second latching means 124 has been overcome by the latch 125. In this position, the locking action shown in FIG. 9A is produced between the latch 125 and the latching means 124. Should an attempt be made to move the further guide means 131 downwardly, i.e. counter to the direction of movement shown, this is not possible due to the locking action.

The latching connection 123 and the latch 125 shown in FIGS. 9A-9C may be combined, for example, with a guide device as described with reference to FIGS. 8A, 8B (not shown). Advantageously, in this case for example the further guide means 131 covers the latching connection 123 provided on the guide means 121 at least in the region above the bottom 103, so that shaped cleaning-agent bodies 102 do not come into contact with the latching connection 123 and thus are not able to become caught therein.

FIGS. 10 to 13 show different embodiments of the bottom 103 which may be used, for example, in a metering device 100 of FIGS. 1 to 4.

Figure 10:
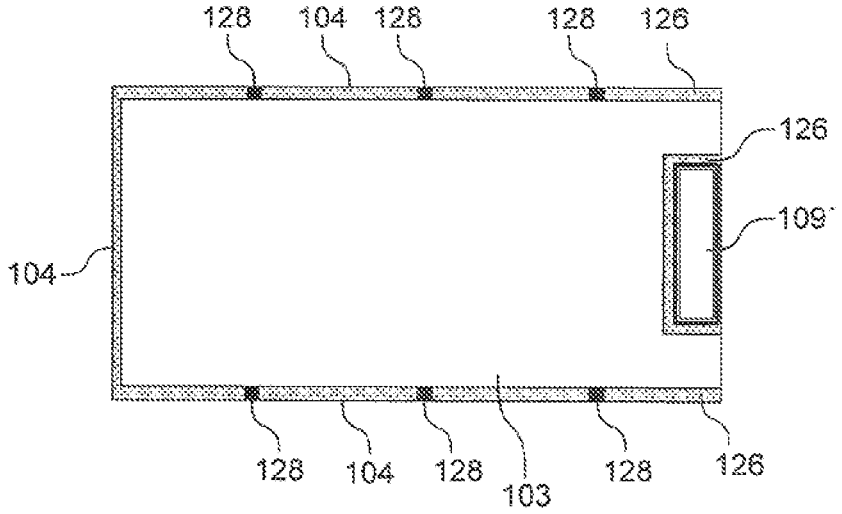
FIG. 10 shows a schematic view of an embodiment of a bottom with a peripheral recess in a reservoir.

FIG. 10 shows a bottom 103 which is configured such that a recess 126 is formed in the form of a gap, at the transition from the bottom 103 to the side walls 104, 105 of the reservoir 101 and at the transition from the bottom 103 to the transport device 109'. In this case, the width of the gap 126 is selected such that the shaped cleaning-agent bodies 102 do not pass through. Moreover, the bottom 103 comprises separators 128 which ensure that the predetermined gap width is maintained. Advantageously, the gap 126 also circulates around the transport device 109'. Thus it is ensured that cleaning-agent particles, such as abraded matter from the shaped cleaning-agent bodies 102 (not shown), do not pass into the transport device 109' which could lead to problems. The cleaning-agent particles fall through the gap 126 into the cavity 127 formed below the bottom 103 (see FIGS. 2 to 6) and are collected there.

Figure 11:
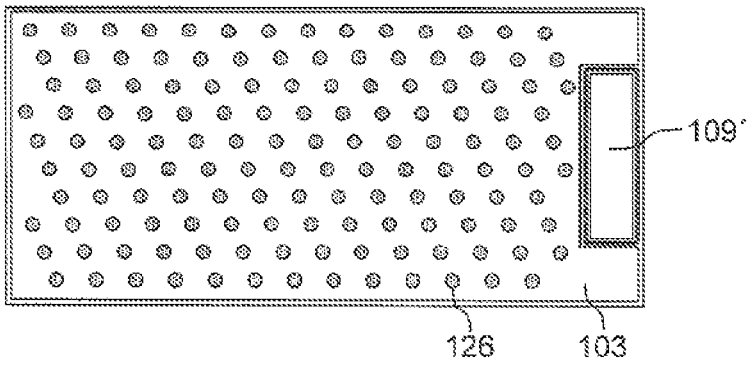
FIG. 11 shows a schematic view of an embodiment of a bottom with a plurality of circular recesses.
Figure 12:
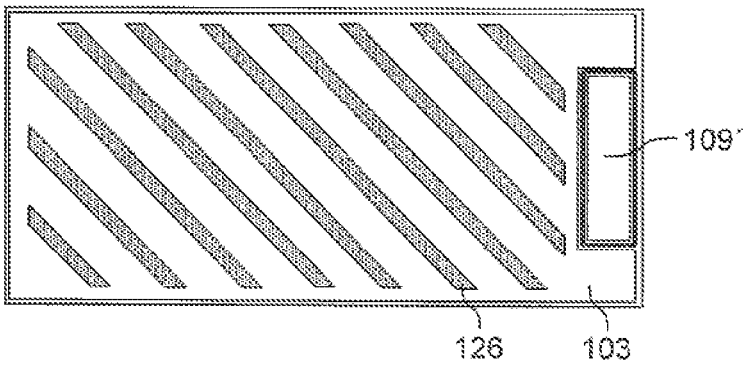
FIG. 12 shows a schematic view of an embodiment of a bottom with a plurality of slotted recesses.
Figure 13:
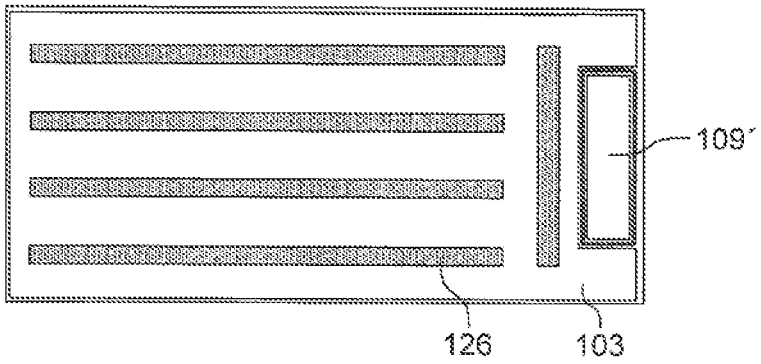
FIG. 13 shows a schematic view of a further embodiment of a bottom with a plurality of slotted recesses.

FIGS. 11 to 13 also show three exemplary embodiments of bottoms 103 advantageously configured in this manner. The exemplary embodiments shown differ from one another only in the shape of the recesses 126. The further details correspond to those in FIG. 10. In contrast to FIG. 10, the recesses 126 in FIGS. 11 to 13, however, are arranged inside the surface of the bottom 103 instead of on the edge thereof. The mode of operation, however, remains the same: cleaning-agent particles (not shown) may pass through the recesses 126 into the cavity 127 below the bottom 103 (see FIGS. 1 to 4), whereby it is avoided that the cleaning-agent particles are supplied to the transport apparatus 109'. It is also possible to combine different exemplary embodiments. For example, it could be provided to configure a bottom 103 with circular and slotted recesses 126 according to FIGS. 11 and 12 and also with gaps 126 on the edge side according to FIG. 10 (not shown).

Figure 14A:
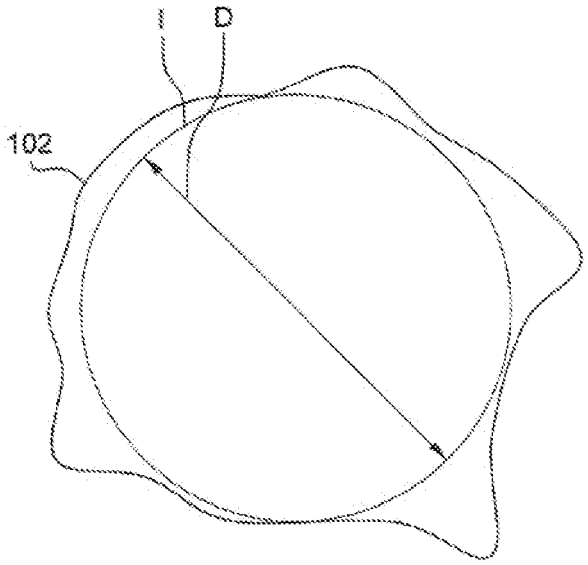
FIGS. 14A and B show a schematic view of a shaped cleaning-agent body and a rectangular recess.

FIG. 14A shows a schematic projection of an irregular-shaped cleaning-agent body 102 and with the illustrated inner circle I. The diameter D of the inner circle I is also indicated.

Figure 14B:
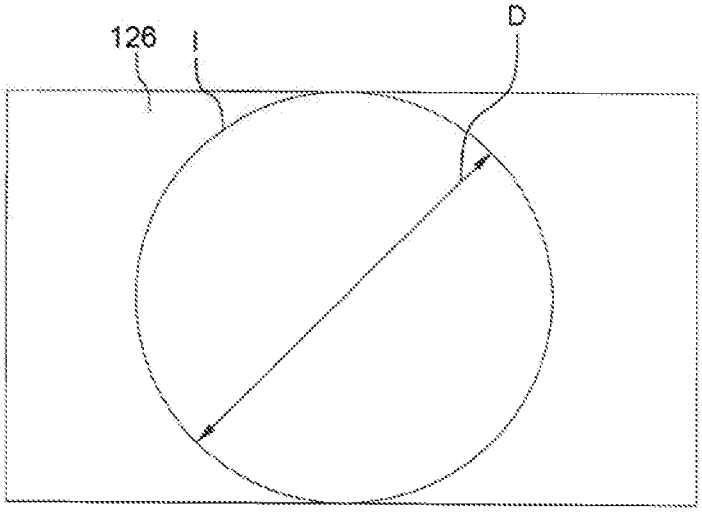

FIG. 14B shows a schematic view of a rectangular recess 126 with the illustrated inner circle I and the diameter D indicated.

A condition which is sufficient for the shaped cleaning-agent body 102 not to fit through the recess 126 is that the diameter D of the inner circle I of the shaped cleaning-agent body 102 (FIG. 14A) is larger than the diameter D of the inner circle I of the recess 126 (FIG. 14B). In particular cases, however, this condition may be broken, wherein this depends on the respective shape of the shaped cleaning-agent body 102 and the recess 126.

Although the present invention has been described with reference to exemplary embodiments, the invention is able to be modified in many different ways. Reference characters used:

The invention claimed is:

1. A metering device for dispensing a cleaning-agent body into a washing chamber of a household dishwasher, said metering device comprising;

a reservoir configured to hold a filling of cleaning-agent bodies and having a transfer opening in a region of a bottom of the reservoir, a transport device configured to actively transport the cleaning-agent bodies from the transfer opening of the reservoir into the washing chamber, and a lifting device configured to raise at least part of the bottom of the reservoir to thereby establish a discharge slant toward the transfer opening or to thereby increase at least part of a downgrade of an existing discharge slant, wherein the lifting device is configured to automatically raise the at least part of the bottom of the reservoir when a quantity of cleaning-agent bodies decreases in the reservoir.

2. The metering device of claim 1, wherein the lifting device comprises a spring to automatically raise the at least part of the bottom.

3. The metering device of claim 2, wherein the spring is configured as a spiral spring or helical spring.

4. The metering device of claim 2, wherein the spring is formed by an elastic strip.

5. The metering device of claim 4, wherein the bottom of the reservoir has a partial region which is formed by the elastic strip.

6. The metering device of claim 1, wherein the lifting device is configured to raise the at least part of the bottom at least partially in response to a reduction of weight of the cleaning-agent bodies.

7. The metering device of claim 1, wherein the lifting device is configured to raise the at least part of the bottom exclusively in response to a reduction of weight of the cleaning-agent bodies.

8. The metering device of claim 1, wherein the bottom of the reservoir is formed as a partially articulated wall.

9. The metering device of claim 1, further comprising a first guide provided for the bottom and arranged on a wall of the reservoir adjacent to the bottom.

10. The metering device of claim 9, further comprising a second guide arranged on the bottom and corresponding to the first guide, said first and second guides cooperating such that, when raised, the bottom is exclusively movable along a path predetermined by the first guide.

11. The metering device of claim 10, wherein the first guide has a rectangular external shape and the second guide has a rectangular internal shape corresponding to the first guide, said second guide configured to fully encompass the first guide or to encompass the first guide by three sides and at least partially by a fourth side.

12. The metering device of claim 10, further comprising:

a latching connection including a plurality of latching members, said latching connection being arranged on a wall of the reservoir adjacent to the bottom and/or on the first guide, and a latch provided on the second guide and/or on the bottom, wherein the latch and the latching members of the latching connection cooperate such that a locking direction along the first guide and a release direction along the first guide limit a raising of the at least part of the bottom.

13. The metering device of claim 12, wherein the latch is configured as an elastic element, wherein an elastic deformation of the elastic element permits a movement of the bottom in the release direction.

14. The metering device of claim 12, wherein neighboring ones of the latching members are distanced from one another by a spacing of a length such as to enable upward and downward movements of the bottom up to an amplitude of the length of the spacing.

15. The metering device of 12, wherein at least one of the first and second guides is configured to at least partially cover the latching connection.

16. A metering device for dispensing a cleaning-agent body into a washing chamber of a household dishwasher, said metering device comprising;

a reservoir configured to hold a filling of cleaning-agent bodies and having a transfer opening in a region of a bottom of the reservoir, a transport device configured to actively transport the cleaning-agent bodies from the transfer opening of the reservoir into the washing chamber, and a lifting device configured to raise at least part of the bottom of the reservoir to thereby establish a discharge slant toward the transfer opening or to thereby increase at least part of a downgrade of an existing discharge slant, wherein the bottom of the reservoir has at least one recess separate and distinct from the transfer opening, which connects the reservoir to a cavity below the bottom, said recess being configured such that the cleaning-agent bodies are prevented from falling through the recess.

17. The metering device of 16, wherein the recess is configured as a gap arranged between the bottom and an adjacent wall of the reservoir.

18. The metering device of claim 16, wherein the recess is configured as at least one member selected from the group consisting of a circular recess, a slotted recess, or a differently shaped recess.

19. A household dishwasher, comprising:

a washing chamber, and a metering device for dispensing a cleaning-agent body into the washing chamber, said metering device comprising a reservoir configured to hold a filling of cleaning-agent bodies and having a transfer opening in a region of a bottom of the reservoir, a transport device configured to actively transport the cleaning-agent bodies from the transfer opening of the reservoir into the washing chamber, and a lifting device configured to raise at least part of the bottom of the reservoir to thereby establish a discharge slant toward the transfer opening or to thereby increase at least part of a downgrade of an existing discharge slant, the household dishwasher further comprising a door, said metering device being arranged on the door, said lifting device of the metering device including a spring to automatically raise the at least part of the bottom only when the door is open.

20. A metering device for dispensing a cleaning-agent body into a washing chamber of a household dishwasher, said metering device comprising:

a reservoir configured to hold a filling of cleaning-agent bodies and having a transfer opening in a region of a bottom of the reservoir, a transport device configured to actively transport the cleaning-agent bodies from the transfer opening of the reservoir into the washing chamber, and a lifting device configured to raise at least part of the bottom of the reservoir to thereby establish a discharge slant toward the transfer opening or to thereby increase at least part of a downgrade of an existing discharge slant, further comprising: a first guide provided for the bottom and arranged on a wall of the reservoir adjacent to the bottom, and a second guide arranged on the bottom and corresponding to the first guide, said first and second guides cooperating such that, when raised, the bottom is exclusively movable along a path predetermined by the first guide.

21. A metering device for dispensing a cleaning-agent body into a washing chamber of a household dishwasher, said metering device comprising:

a reservoir configured to hold a filling of cleaning-agent bodies and having a transfer opening in a region of a bottom of the reservoir, a transport device configured to actively transport the cleaning-agent bodies from the transfer opening of the reservoir into the washing chamber, and a lifting device configured to raise at least part of the bottom of the reservoir to thereby establish a discharge slant toward the transfer opening or to thereby increase at least part of a downgrade of an existing discharge slant, wherein the lifting device is configured to raise the at least part of the bottom at least partially in response to a reduction of weight of the cleaning-agent bodies.

* * * * *